US011002429B2

(12) United States Patent
Martin

(10) Patent No.: US 11,002,429 B2
(45) Date of Patent: May 11, 2021

(54) MAGNETICALLY COUPLED MOVABLE LIGHTING DEVICE

(71) Applicant: SAL LONDON LIMITED, London (GB)

(72) Inventor: Ian Martin, London (GB)

(73) Assignee: SAL LONDON LIMITED, London (GB)

( * ) Notice: Subject to any disclaimer, the term of this patent is extended or adjusted under 35 U.S.C. 154(b) by 0 days.

(21) Appl. No.: 15/507,572

(22) PCT Filed: Aug. 27, 2015

(86) PCT No.: PCT/GB2015/052484
§ 371 (c)(1),
(2) Date: Feb. 28, 2017

(87) PCT Pub. No.: WO2016/030686
PCT Pub. Date: Mar. 3, 2016

(65) Prior Publication Data

US 2017/0284640 A1 Oct. 5, 2017

(30) Foreign Application Priority Data

Aug. 29, 2014 (GB) ..... 1415351

(51) Int. Cl.
*F21V 14/02* (2006.01)
*F21V 21/34* (2006.01)
(Continued)

(52) U.S. Cl.
CPC ..... *F21V 14/02* (2013.01); *F21S 6/005* (2013.01); *F21S 8/081* (2013.01); *F21V 17/105* (2013.01); *F21V 21/34* (2013.01); *F21V 23/0485* (2013.01)

(58) Field of Classification Search
CPC ..... F21V 14/02; F21V 21/34; F21V 17/105; F21V 14/025; F21S 6/005; F21S 8/081; F21L 13/00
(Continued)

(56) References Cited

U.S. PATENT DOCUMENTS 4,441,145 A 4/1984 Antkowiak
4,694,381 A 9/1987 Dedoro
(Continued)

FOREIGN PATENT DOCUMENTS

CN 2806963 Y 8/2006
CN 203718438 U 7/2014
(Continued)

OTHER PUBLICATIONS

International Search Report and Written Opinion of the International Search Authority (forms PCT/ISA/210 and PCT/ISA/237) and Notification of Transmittal of the International Search Report and Written Opinion of the International Search Authority (form PCT/ISA/220), for International Application No. PCT/GB2015/052484 dated Oct. 12, 2015 (10 pages).
(Continued)

*Primary Examiner* — Karabi Guharay
(74) *Attorney, Agent, or Firm* — Womble Bond Dickinson (US) LLP

(57) ABSTRACT

A lighting device for illuminating a room or enclosed space comprising: a light source; and a support adapted to support the light source, the support having a surface which defines a guide path. The light source is adapted to be movable relative to the support along the guide path between first and second lighting positions.

8 Claims, 12 Drawing Sheets

(51) Int. Cl.

| | |
|---|---|
| ***F21V 17/10*** | (2006.01) |
| ***F21V 23/04*** | (2006.01) |
| ***F21S 8/08*** | (2006.01) |
| ***F21S 6/00*** | (2006.01) |

(58) Field of Classification Search
USPC ..... 362/286, 291, 249.07
See application file for complete search history.

(56) References Cited

U.S. PATENT DOCUMENTS

| | | | | |
|---|---|---|---|---|
| 4,974,134 | A | 11/1990 | Bourne | |
| 5,993,030 | A | 11/1999 | Barcel | |
| 6,866,403 | B1 * | 3/2005 | Schaak | F21S 6/002 362/220 |
| 8,506,136 | B1 | 8/2013 | Herdt | |
| 2003/0141420 | A1 | 7/2003 | Knight | |
| 2008/0219652 | A1 * | 9/2008 | Pitkin | G03B 15/02 396/4 |
| 2009/0109670 | A1 | 4/2009 | Boyer | |
| 2010/0067244 | A1 | 3/2010 | Cartwright | |
| 2012/0314418 | A1 * | 12/2012 | Byrne | F21V 21/22 362/285 |
| 2013/0301260 | A1 | 11/2013 | Huang | |

FOREIGN PATENT DOCUMENTS

| | | | |
|---|---|---|---|
| EP | 0602741 | A1 | 6/1994 |
| EP | 2573459 | A1 | 3/2013 |
| KR | 10-2012-0051230 | A | 5/2012 |
| WO | 2014/081842 | A1 | 5/2014 |

OTHER PUBLICATIONS

Search Report for United Kingdom Patent Application No. GB1415351.4 dated Feb. 9, 2015 (3 pages).
Office Action received for European Patent Application No. 15757556.4, dated Jul. 19, 2018, 6 pages.
International Preliminary Report on Patentability received for PCT Patent Application No. PCT/GB2015/052484, dated Mar. 9, 2017, 7 pages.
Office Action received for European Patent Application No. 15757556.4, dated Mar. 31, 2020, 8 pages.
EPO Office Action dated Jul. 17, 2019; Application No. 15757556.4; 4 pages.
"Third Office Action," CN Application No. 201580051924.7 dated Apr. 10, 2020, 6 pages.
Office Action received for GB Patent Application No. 1415351.4, dated Dec. 7, 2020, 4 pages.

* cited by examiner

MAGNETICALLY COUPLED MOVABLE LIGHTING DEVICE

CROSS-REFERENCE TO RELATED APPLICATIONS

This application is a 35 U.S.C. § 371 national phase filing of International Application No. PCT/GB2015/052484 filed Aug. 27, 2015, and claims the benefit of United Kingdom Patent Application No. 1415351.4 filed Aug. 29, 2014. The entire disclosures of the foregoing applications are hereby incorporated by reference herein in their respective entireties.

FIELD OF INVENTION

The present invention relates to a lighting device and more particularly to a lighting device for illuminating a room or enclosed area.

BACKGROUND TO THE INVENTION

Lighting devices for lighting rooms or enclosed areas are well-known. Such lighting devices include ceiling- or wall-mounted light sources (or lamps) and floor-standing lamps.

Many configurations of floor-standing lamps are currently available. Such floor-standing lamps typically have upwardly projecting posts or support structures that are attached to a base. Alternatively, the floor-standing lamps may be supported on legs that are symmetrically placed about the post or support structure. Some floor-standing lamps have posts or support structures that are directed away from the vertical in their upper lengths, thus allowing the light source(s) or luminaire to be held off-centre.

Such conventional lighting devices are typically designed with a combination of functionality and appearance in mind. With the function of a lighting device being comparatively simple (e.g. simply turning on or off), particular importance and/or value may be placed on the appearance of a lighting device.

It is therefore desirable to develop an aesthetically pleasing lighting device that may be suitable for illuminating a room or enclosed area, for example.

SUMMARY OF THE INVENTION

According to a first aspect of the invention, there is provided a lighting device for illuminating a room or enclosed space comprising: a light source; and a support adapted to support the light source, the support having a surface which defines a guide path, wherein the light source is adapted to be movable relative to the support along the guide path between first and second lighting positions.

Embodiments may provide an aesthetically pleasing lighting device that is arranged in consideration of the lighting function provided by the lighting device.

Unlike the appearance of a conventional lighting device, which is typically considered in the context of its general overall appearance and irrespective of its lighting status (e.g. whether or not it is turned on/off), embodiments are designed to have an appearance which may incorporate the lighting status of the lighting device into its appearance.

In an embodiment, the light source may be adapted to emit light of a first intensity at the first lighting position and to emit light of a second, differing intensity at the second light position. Further, the light source may be adapted to be off when at the first lighting position and to be on when at the second lighting position. In this way, an embodiment may have a different appearance depending on the position and/or light-emission level of the light source, for example.

Also, in an embodiment, the light source may be adapted to gradually change the intensity of emitted light as it is moved between the first and second positions. Such an embodiment may therefore be adapted to replicate or simulate the process of a sun rising or setting, for example. A visual or dramatic effect may therefore be created by the lighting device through controlled variation of the position and/or brightness of the light source.

The light source may be adapted to move between the first and second lighting positions in response to the lighting device being activated or deactivated. Such activation/deactivation may be controlled by a user (pressing a switch for example), a timer, or an automatic control unit, for example.

Embodiments may further comprising a drive arrangement adapt to move the light source between the first and second lighting positions. The drive arrangement may, by way of example, comprise at least one of the following: a motor and pulley system; a magnetic propulsion system; a flexible screw arrangement; a pneumatic propulsion; a rack and pinion mechanism; a tension spring; a threaded rod having sections with differing thread lead; and a gearing arrangement. Such features/components of the drive arrangement may be at least partially housed within the support, so as to provide an aesthetically pleasing appearance, whereby the drive arrangement is partially or totally hidden from the view of a user.

In an embodiment, the light source may magnetically-coupled to the drive arrangement. In this way, the drive arrangement may be physically separated from (i.e. not it physical contact with) the light source, thereby enabling the drive arrangement to be housed within the support and hidden/concealed from view. Further, the magnetic coupling between the light source and the drive arrangement may be employed generate light through electromagnetic induction. In other words, electromagnetic induction may be used to generate a voltage/current in the light source for the purpose of operating the light source even where a physical connection between the light source and a power source is not present.

The light source may comprise a plurality of sub light sources. Such sub-sources may be adapted to move relative to each other as the light source is moved between the first and second lighting positions. In this way, the light source may provide the appearance of expanding or contracting when it is switched on or off, for example.

Embodiments may be floor-standing, thereby providing a floor-standing lighting device that is suitable for illuminating a room or enclosed space.

BRIEF DESCRIPTION OF THE DRAWINGS

An example of the invention will now be described with reference to the accompanying diagrams, in which.

DETAILED DESCRIPTION

Terms describing positioning or location (such as above, below, top, bottom, etc.) are to be construed in conjunction with the orientation of the structures illustrated in the diagrams.

The diagrams are purely schematic and it should therefore be understood that the dimensions of features are not drawn to scale. Accordingly, the illustrated thickness of any of the layers should not be taken as limiting. For example, a first layer drawn as being thicker than a second layer may, in practice, be thinner than the second layer.

Figure 1B:
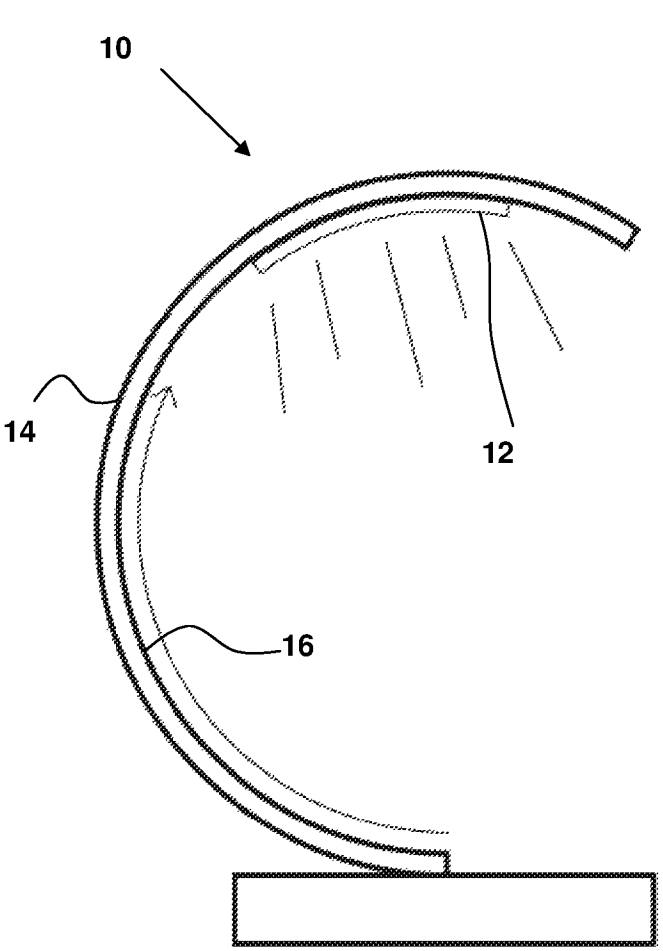
FIG. 1B shows the lighting device of FIG. 1A, wherein the light source is moved to a second position.
Figure 1A:
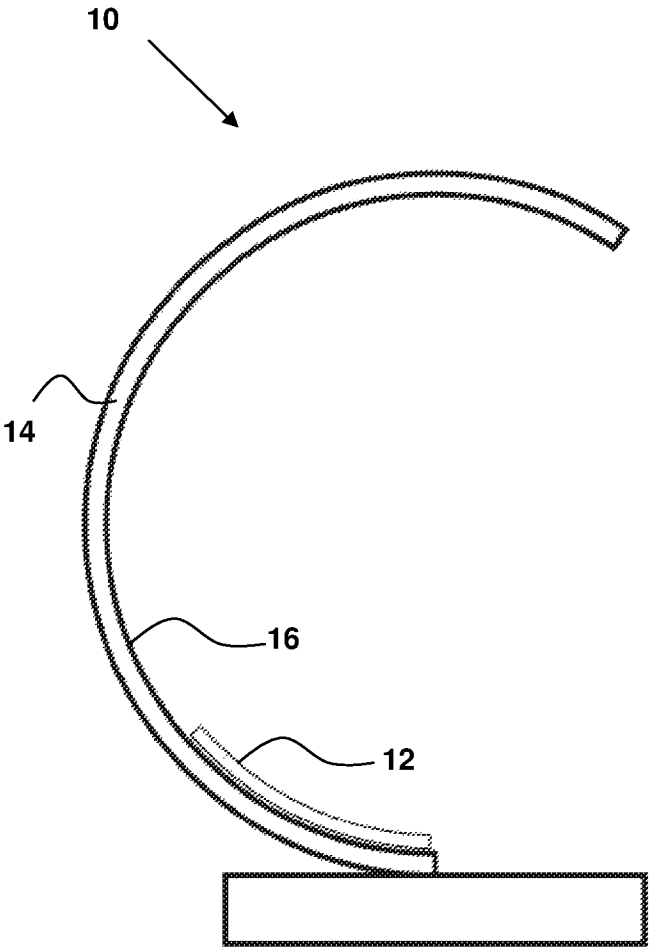
FIG. 1A depicts a lighting device according to an embodiment, wherein the light source is in a first position.

Referring to FIG. 1, there is illustrated a simplified illustration of a lighting device 10 according to an embodiment. More specifically, FIG. 1A depicts the lighting device with its light source 12 is in a first position, and FIG. 1B depicts the lighting device with the light source 12 in a second position.

The lighting device 10 is for illuminating a room or enclosed space and may be floor or wall mounted, for example. The lighting device 10 comprises a light source 12, and a rigid support 14 adapted to support the light source 12. The support 14 comprises a metal extrusion that is curved so as to form a part-circular (e.g. C-shaped) support having a inwardly facing support surface 16 (e.g. a surface facing toward the center of curvature). The support surface defines a guide path along which the light source is adapted to be movable between first and second lighting positions.

When the light source 12 is in the first lighting position (as shown in FIG. 1A), the light source 12 is switched off so that it does not emit any light. In other words, when in the first lighting position, the light source 12 emits light of zero intensity. Conversely, when the light source 12 is in the second lighting position (as shown in FIG. 1B), the light source 12 is switched on so that it emits light of non-zero intensity.

In this embodiment, the light source 12 is adapted to gradually change the intensity of emitted light as it is moved between the first and second positions.

Thus, when moving from the first lighting position to the second lighting position, the intensity of light emitted from the light source 12 increases from zero to the non-zero value. Conversely, when moving from the second lighting position to the first lighting position, the intensity of light emitted from the light source 12 decreases from the non-zero value to zero.

Here, the light source 12 is adapted to move between the first and second positions in response to the lighting device 10 being activated or deactivated. Such activation/deactivation is controlled by a user (pressing a switch for example), a timer, automatic control unit, etc. associated with the lighting device.

In order to physically move the light source along the guide path defined by the support surface, a drive arrangement is employed. In this example, the drive arrangement is housed within the support 14 so that it is hidden from view. Here, the drive arrangement comprises a motor and pulley system which is connected to the light source 12. Activation/deactivation of the lighting device 10 activation/deactivates the motor, respectively.

It will, however, be appreciated that other drive arrangements may be employed such as any one (or a combination) of the following: a motor and pulley system; a magnetic propulsion system; a flexible screw arrangement; a pneumatic propulsion; a rack and pinion mechanism; a tension spring; and a gearing arrangement. Also, the features or components of such drive arrangements may be partially or fully housed within the support, so as to provide an aesthetically pleasing appearance of the lighting device.

Figure 2B:
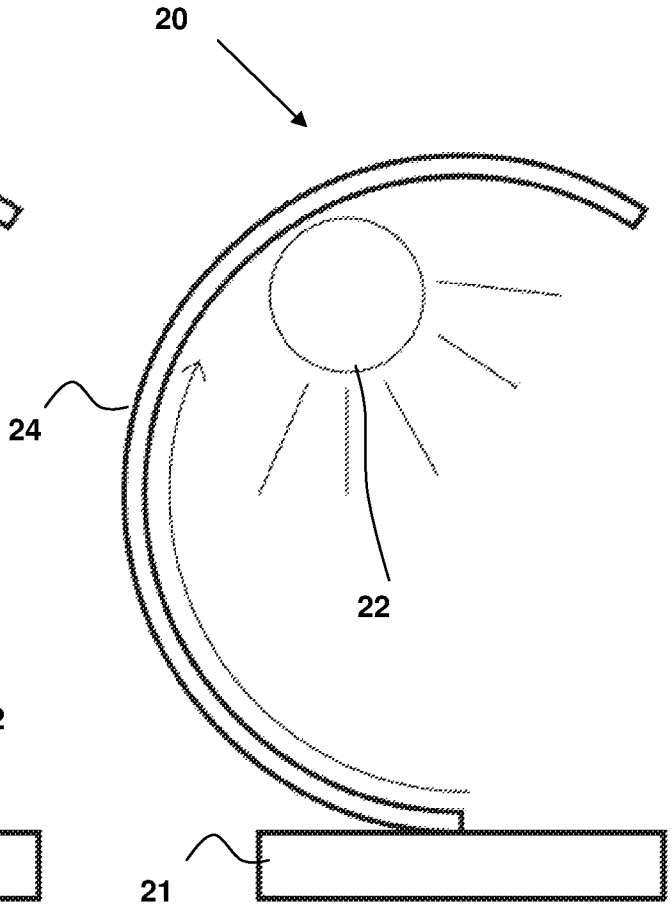
FIGS. 2A & 2B depict a lighting device according to another embodiment, wherein the light source is in a first and second position, respectively.
Figure 2A:
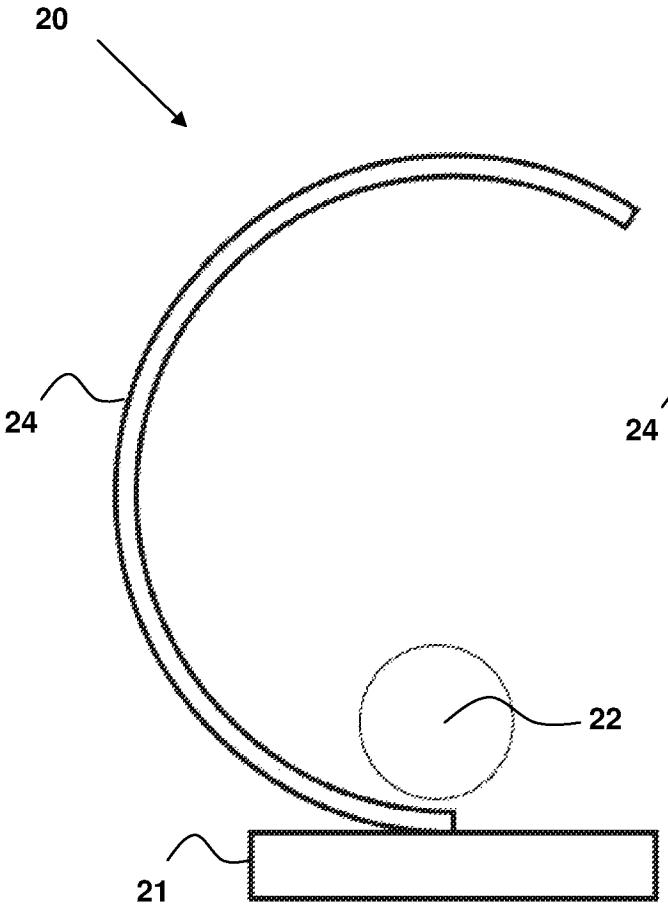

Referring now to FIG. 2, there is illustrated a lighting device 20 according to another embodiment. FIG. 2A depicts the lighting device with its light source 22 is in a first position (and switched off), and FIG. 2B depicts the lighting device with the light source 22 in a second, "switched on" position.

The lighting device 20 is floor-standing. It comprises a base 21 for supporting the lighting device on a substantially horizontal floor surface. The lighting device 20 also comprises a light source 22, and a rigid support 24 adapted to support the light source 22. The support 24 comprises a curved metal rod that projects upwardly from the base at one and the curves along its longitudinal length so that the other end of the rod points downwardly towards the floor. The curved metal rod of the support 24 defines a curved a guide path along which the light source 22 is adapted to move between first and second lighting positions.

When the light source 22 is in the first lighting position (as shown in FIG. 2A), the light source 22 is switched off so that it does not emit any light.

Conversely, when the light source 22 is in the second lighting position (as shown in FIG. 2B), the light source 22 is switched on so that it emits light of a predetermined, non-zero intensity.

In this embodiment, the light source 22 is adapted to gradually change the intensity of emitted light as it is moved between the first and second positions. Thus, when moving from the first lighting position to the second lighting position, the intensity of light emitted from the light source 22 increases from zero to the non-zero value. Conversely, when moving from the second lighting position to the first lighting position, the intensity of light emitted from the light source 22 decreases from the non-zero value to zero.

The light source 22 moves between the first and second positions in response to the lighting device 20 being activated or deactivated. Such activation/deactivation is controlled by a user (pressing a switch for example), a timer, automatic control unit, etc. associated with the lighting device.

In this embodiment, the light source 22 comprises a generally spherical shape and is adapted to roll along the support 24 as it moves between the first and second lighting positions. More specifically, a drive arrangement is housed within the ball-like light source 22 and cooperates with the support 24 to roll the light source along the guide path defined by the support 24. By way of example only, the drive arrangement of this embodiment employs a motor and teethed gear system that is connected to a track provided on the support 24.

Figure 3:
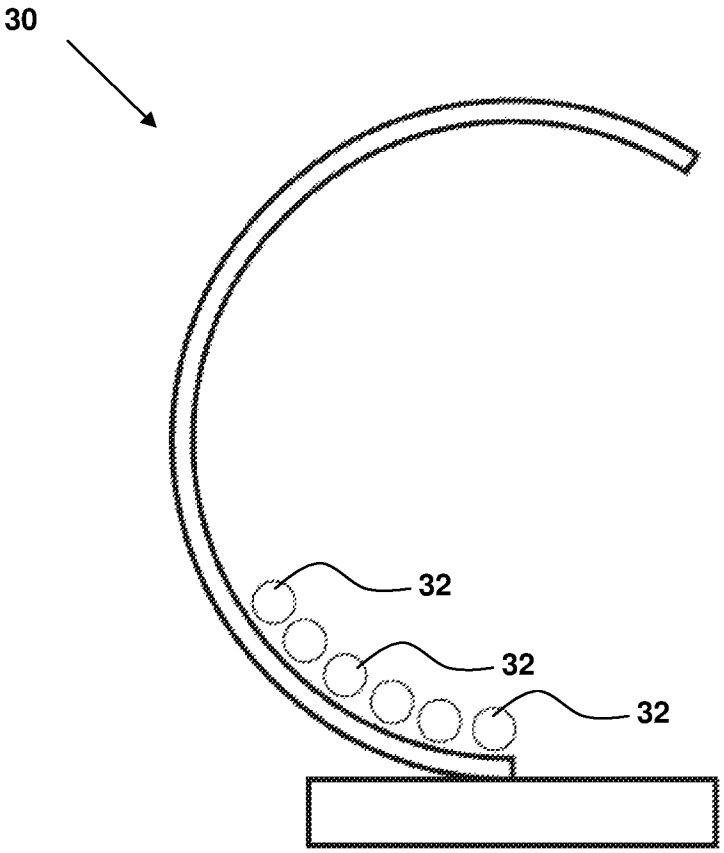
FIG. 3 shows a modified version of the lighting device of FIGS. 1A and 1B.

Turning to FIG. 3, there is shown a modified version of the lighting device of FIG. 1. The lighting device 30 of FIG. 3 is similar to the lighting device 10 of FIG. 1, and so detailed description of its similar features/components is omitted to avoid unnecessary repetition. It is noted, however, that the lighting device 30 of FIG. 3 differs from the lighting device 10 of FIG. 1 in that the lighting device 30 of FIG. 3 has a light source which comprises a plurality of sub light sources 32.

The sub light sources 32 are adapted to move relative to each other as the light source is moved between the first and second lighting positions. Here, the sub light sources 32 can be moved and lit independently from each other, Thus, as depicted in FIG. 3, a first set of the sub light sources may be switched on and moved to one end the guide path, whist a second set of the sub light sources may be switched off and positioned as the other end of the guide path.

Also, the sub light sources 32 are adapted to simply switch off or on (so that they only emit light of either zero intensity or a predetermined value, for example), so that the total intensity of light emitted from the lighting device 30 is varied by varying the number of sub light source 32 that are switched on. For example, the overall light emitted from the lighting device 30 may be increasing the number of sub light sources 32 that are switched on, and vice-versa.

Figure 4B:
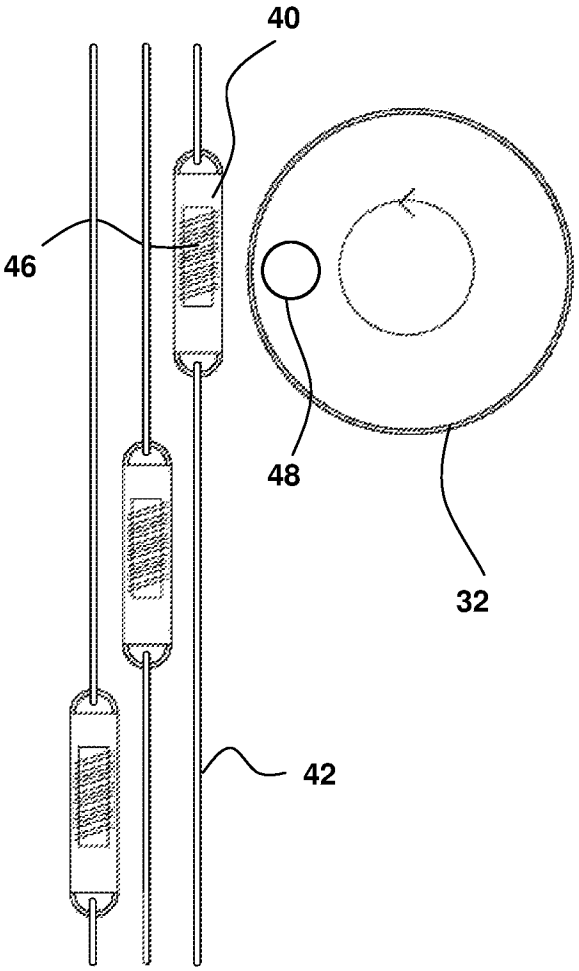
FIGS. 4A & 4B depict first and second drive arrangements, respectively, for the embodiment of FIG. 3.
Figure 4A:
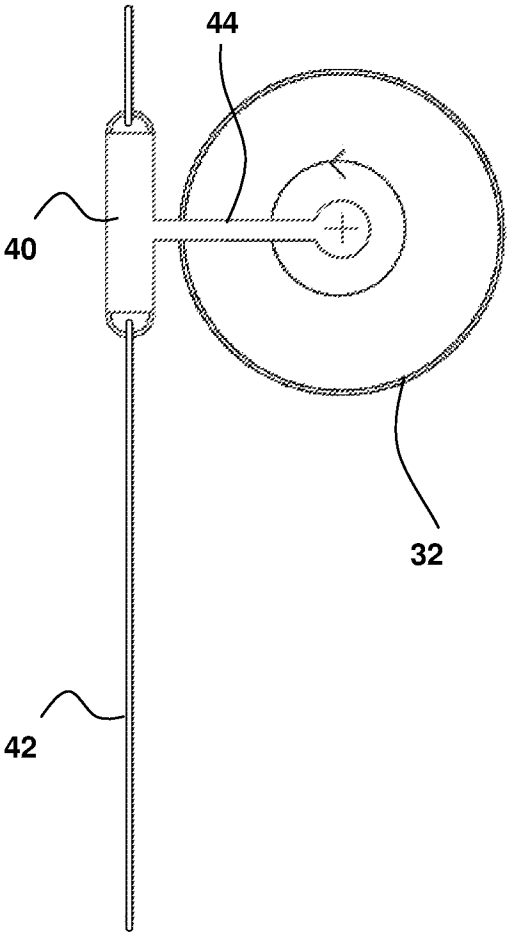

By way of example, FIGS. 4A and 4B depict first and second drive arrangements, respectively, for the embodiment of FIG. 3.

Referring to FIG. 4A, the drive arrangement comprises a carriage 40 on a pulley wire 42. The pulley wire 42 is moved by a motor (not shown), so that the carriage 40 can be moved between first and second positions, for example. The sub light source 32 is mounted on the carriage 40 via a connecting rod 44. Movement of the carriage 40 thus creates corresponding movement of the sub light source 32. The pulley wire 42 may be situated inside the support 24 of the lighting device with the connecting rod 44 projecting outwardly through a channel formed in the support 24 (so that the sub light source 32 is situated external to the support 24).

Referring to FIG. 4B, the drive arrangement is similar to that of FIG. 4A. However, instead of the sub light source 32 being mounted on the carriage 40 via a connecting rod, the sub light source is magnetically coupled to magnet 46 positioned in/on the carriage 40. Thus, there is no physical connection between the carriage 40 and the sub light source 32. The sub light source 32 is instead coupled to the carriage 40 via a magnetic attractive force between the magnet 46 and a ball bearing 48 situated inside the sub light source 32. As with the arrangement of FIG. 4A, the pulley wire 42 of the arrangement of FIG. 4B may be situated inside the support 24 of the lighting device with the corresponding sub light source 32 situated adjacent to the magnet 46 and external to the support 24. In this way, the pulley wire 42 and carriage 40 may be hidden from view (e.g. in the support 24) and the sub light source 32 may be perceived to slide along the surface of the support 24 which defines the guide path.

For the arrangement of FIG. 4B, it is noted that the magnetic coupling between the light source 32 and the carriage 40 may be employed generate light through electromagnetic induction. In other words, electromagnetic induction may be used to generate a voltage/current in the light source 32 for the purpose of operating the light source 32 even where a physical connection between the light source 32 and a power source is not present.

Figure 5B:
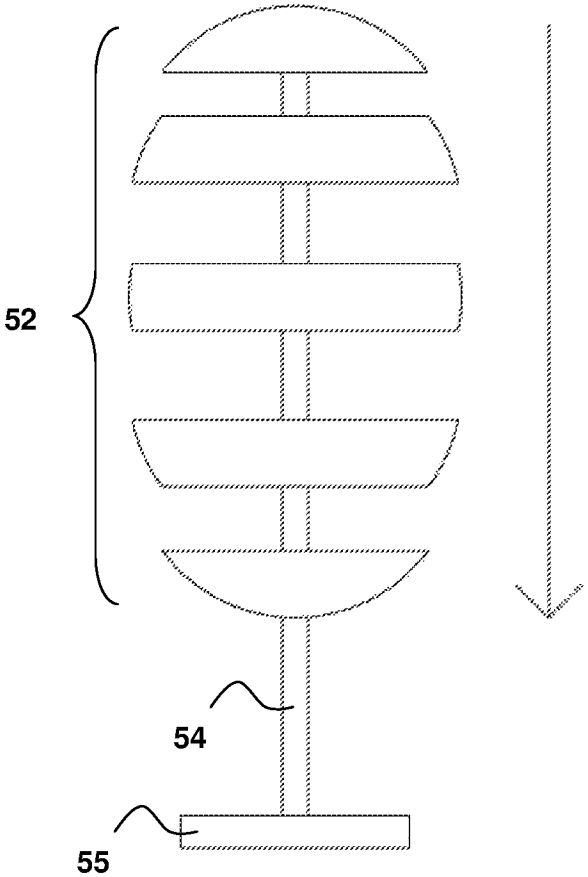
FIGS. 5A and 5B depict a lighting device according to another embodiment, wherein the light source is in a first and second position, respectively.
Figure 5A:
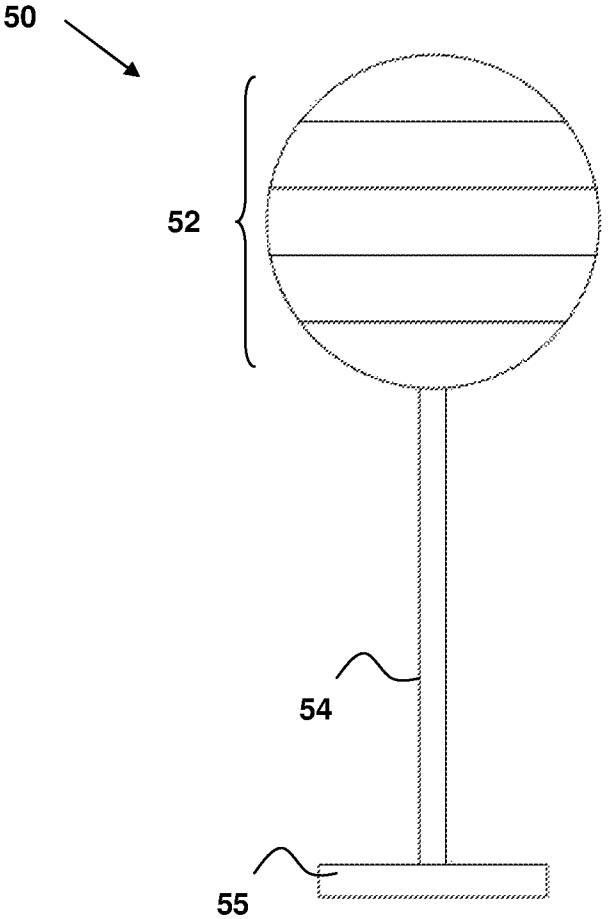

Referring now to FIG. 5, there is illustrated a lighting device 50 according to yet another embodiment. More specifically, FIG. 5A depicts the lighting device with its light source 52 is in a first position, and FIG. 5B depicts the lighting device with the light source 52 in a second position.

The lighting device 50 is a floor-standing device for illuminating a room or enclosed space, for example. The lighting device 50 comprises a light source 52, and a rigid vertical support 54 adapted to support the light source 52. The support 54 comprises a linear, hollow metal rod that is arranged to project substantially vertically from a base 55. The support 54 has an outer surface defining a guide path along which the light source 52 is adapted to be movable between first and second lighting positions.

The light source 52 comprises a plurality of sub light sources formed as segments of a generally spherical ball. In other words, the light source 52 comprises a generally spherical ball formed from a plurality of segments, each segment being (or providing) a sub light source.

The plurality of sub light sources (or segments) are adapted to move relative to each other as the light source is moved between the first and second lighting positions. More specifically, in this embodiment, the sub light sources (or segments) are adapted to move apart/towards each other so that the light source appears to expand/contract when it sis moved between first and second lighting positions.

When the light source 52 is in the first lighting position (as shown in FIG. 5A), the light source 52 is in a contracted configuration, wherein the sub light sources (or segments) are closely packed or contact each other so that they form a generally spherical ball. The light emitted by the sub light sources when in this first lighting position may be of a predetermined intensity, but partially (or fully) blocked by the contracted configuration of the light source 52. In other words, contraction of the sub light sources (or segments) together in the first lighting position may prevent or reduce the light from being emitted outwardly from the light source.

Conversely, when the light source 52 is in the second lighting position (as shown in FIG. 5B), the light source 52 is in an expanded configuration, wherein the sub light sources (or segments) are separated from each other (e.g. spaced apart). The light emitted by the sub light sources when in this second lighting position may be of a predetermined intensity, but not blocked by the expanded configuration of the light source 52. In other words, expansion of the sub light sources (or segments) away from each other in the second lighting position may permit more light to be emitted outwardly from the light source.

Thus, the sub light sources may be adapted to generate light of the same intensity when in the first and second lighting positions, but the amount of light emitted from the light source may be differed according to the separation between the sub light sources. The embodiment of FIG. 5 may therefore be adapted to gradually change the amount of emitted light as it is moved between the expanded and contracted configurations. Thus, when moving from the contracted configuration to the expanded configuration, the overall amount of light emitted from the light source increases from near zero to a non-zero value. Conversely, when moving from the expanded configuration to the contracted configuration, the overall amount of light emitted from the light source decreases from the non-zero value to near zero.

Here, the light source 52 is adapted to move between the expanded and contracted configurations in response to the lighting device 50 being activated or deactivated. Such activation/deactivation is controlled by a user (pressing a switch for example), a timer, automatic control unit, etc. associated with the lighting device.

In order to physically move the sub light sources 52 along the guide path defined by the support 54, a drive arrangement is employed. In this example, the drive arrangement is housed within the support 54 so that it is hidden from view. Here, the drive arrangement comprises a resilient member (such as a spring) which is connected to the sub light sources 52. Activation/deactivation of the lighting device 50 activation/deactivates a force applied to the resilient member.

Figures 6A, 6B:
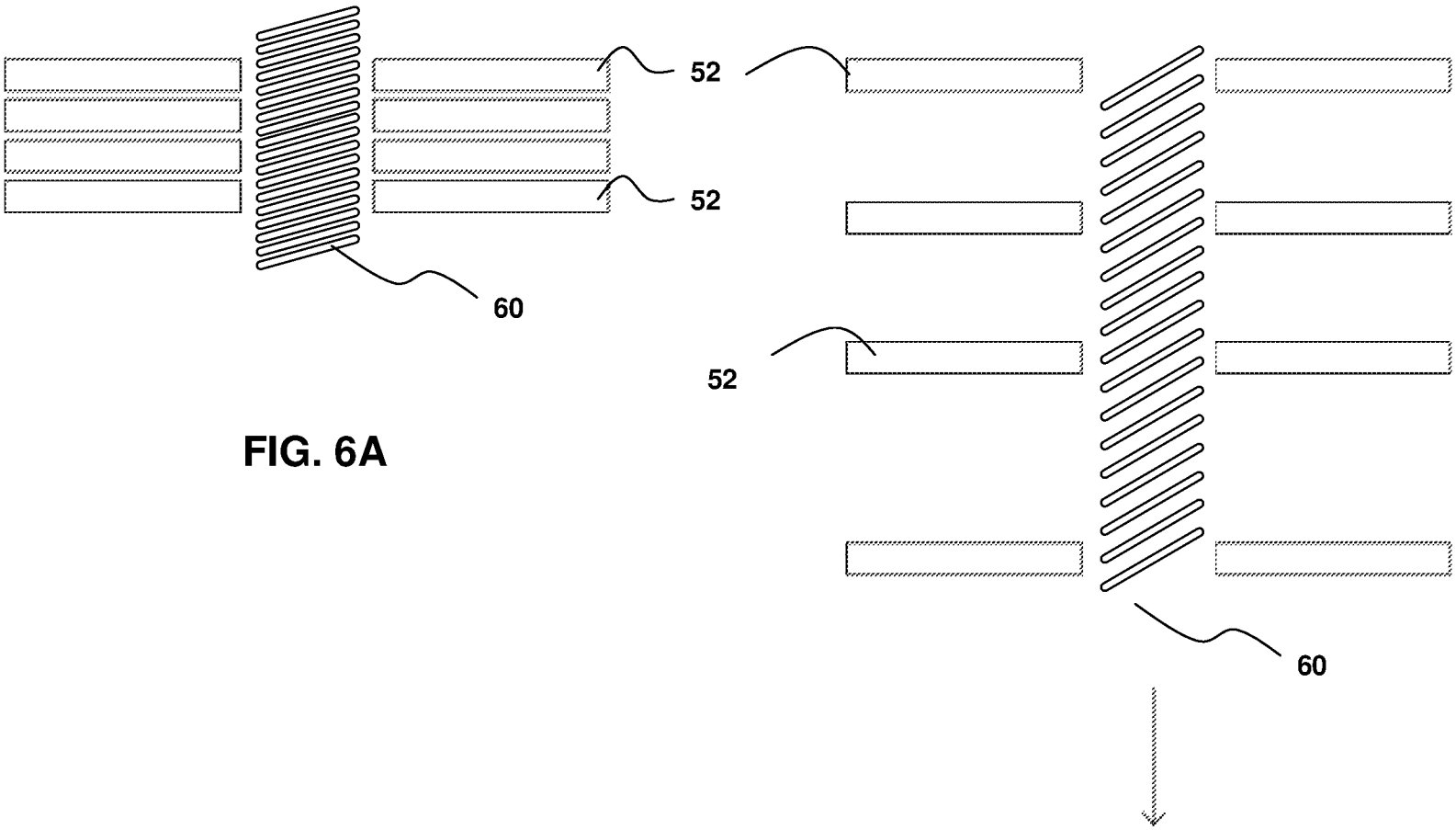
FIGS. 6A & 6B depict a drive arrangement for the embodiment of FIGS. 5A and 5B, wherein the drive arrangement is moved between a contracted and expanded configuration, respectively.

By way of example, FIGS. 6A and 6B depict a possible drive arrangement for the embodiment of FIGS. 5A and 5B, wherein the drive arrangement is moved between a contracted and expanded configuration, respectively.

The drive arrangement comprises a tension spring 60. The tension spring 60 is moved by a pulling force applied to the spring 60 (by a motor and wire, for example), so that the spring can be moved between a contracted configuration (depicted in FIG. 6A) and an expanded configuration (depicted in FIG. 6B), for example. The sub light sources 52 are mounted at various positions on the spring 60. Expansion/contraction of the spring 60 thus results in corresponding movement of the sub light sources 52. The spring 60 may be situated inside the hollow support 54 of the lighting device 50. In this way, the spring 60 may be hidden from view (e.g. in the support 54) and the sub light sources 52 may be perceived to slide along the outer surface of the support 54 which defines the guide path.

Figures 7A, 7B:
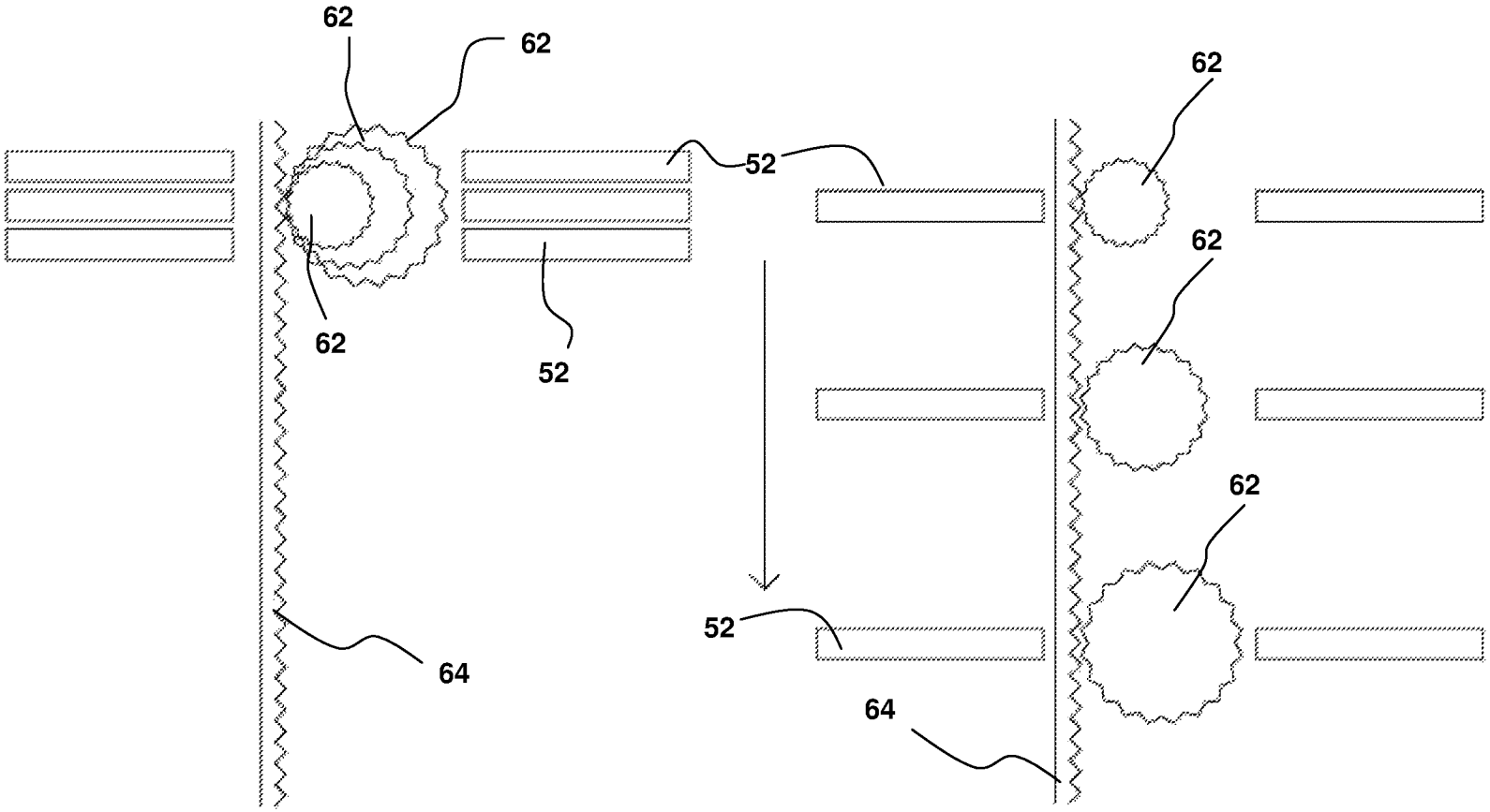
FIGS. 7A & 7B depict another drive arrangement for the embodiment of FIGS. 5A and 5B, wherein the drive arrangement is moved between a first and second configuration, respectively.

FIGS. 7A and 7B depict another possible drive arrangement for the embodiment of FIGS. 5A and 5B, wherein the drive arrangement is moved between a first and second configuration, respectively.

The drive arrangement comprises a set of differently sized pinion gears 62 arranged to travel along a rack 64. The pinion gears 62 are moved (e.g. rotated) by one or motors so that they can roll along the rack 64 and thus be moved between a contracted configuration (depicted in FIG. 7A) and an expanded configuration (depicted in FIG. 7B), for example. Each of the sub light sources 52 are connected to a respective pinion gear 62. Movement of the pinion gears 62 along the rack 64 thus results in corresponding movement of the sub light sources 52. The differing sizes of the pinion gears 62 results in the gears 62 moving along the rack 64 by corresponding differing amounts and, in turn, results in the sub light sources also moving by differing amounts. In this way, the sub light sources 52 can be moved with respect to each other, enabling the separation between sub light sources 52 to be altered (e.g. reduced or increased).

The gears 62 and rack 64 may be situated inside the hollow support 54 of the lighting device 50. In this way, they may be hidden from view (e.g. in the support 54) and the sub light sources 52 may be perceived to slide along the outer surface of the support 54 which defines the guide path.

Figure 8B:
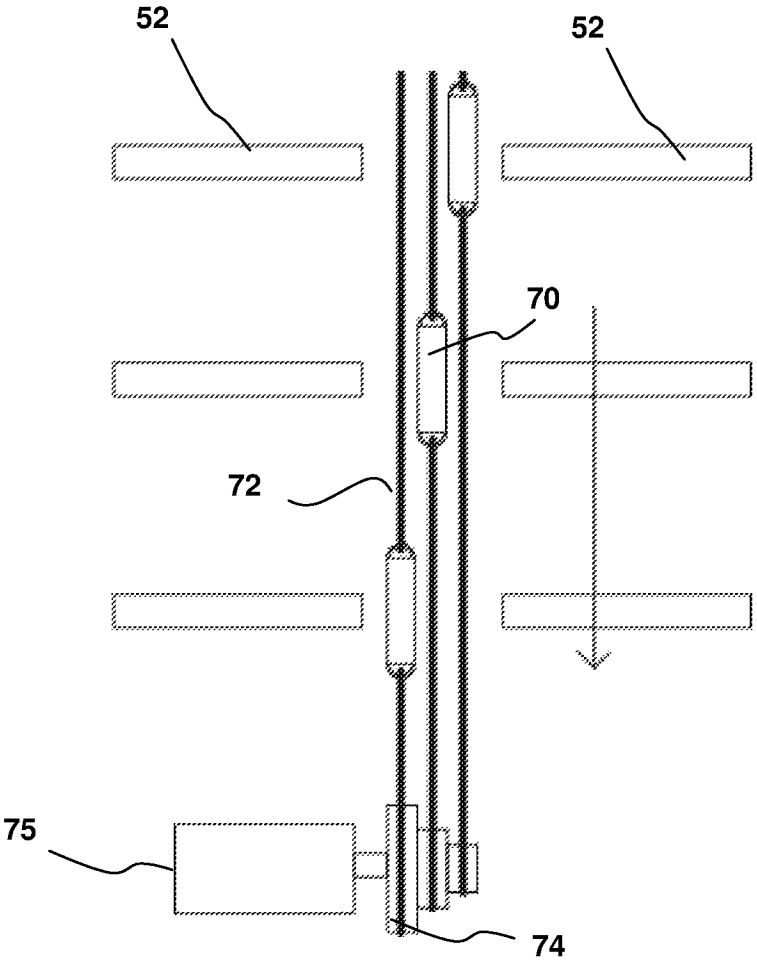
FIGS. 8A & 8B depict yet another drive arrangement for the embodiment of FIGS. 5A and 5B, wherein the drive arrangement is moved between a first and second configuration, respectively.
Figure 8A:
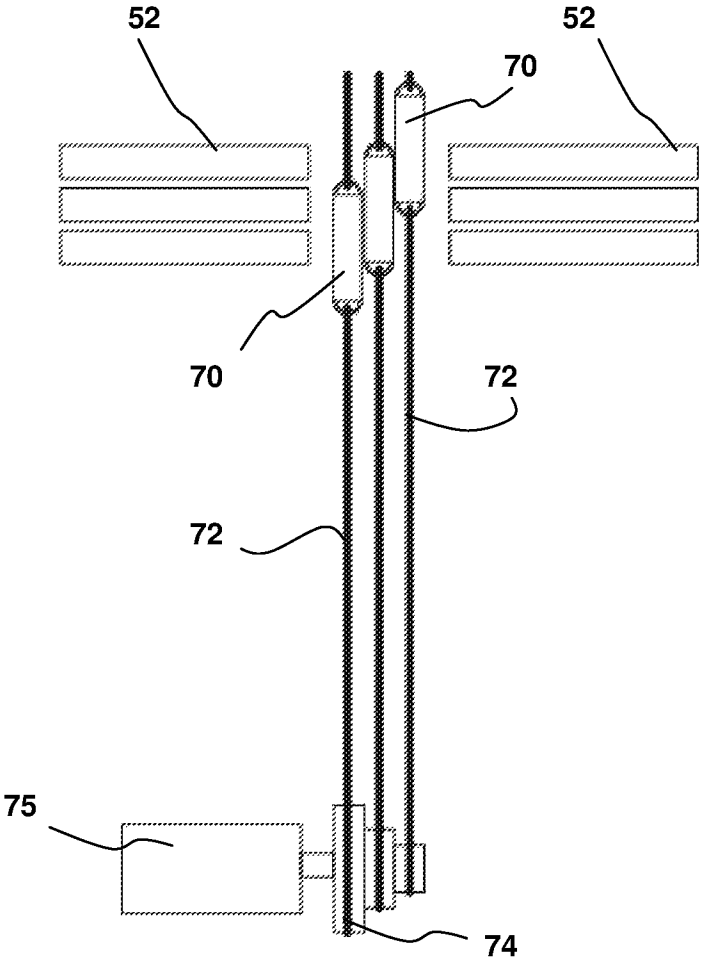

FIGS. 8A and 8B depict another possible drive arrangement for the embodiment of FIGS. 5A and 5B, wherein the drive arrangement is moved between a first and second configuration, respectively.

The drive arrangement comprises a set of carriages 70 mounted on a respective set of pulley wires 72. The pulley wires are connected to a respective set of pulleys 74 that are adapted to be rotated by a motor 75. Each pulley of the set is of a different size such that a single rotation of the motor causes each carriage to be moved by a corresponding different amount/distance. Connected to each carriage 70 is a respective pair of sub light sources 52. The differing movement of the carriages moves the sub light sources 52 between a contracted configuration (depicted in FIG. 8A) and an expanded configuration (depicted in FIG. 8B), for example. In other words, rotation of the motor causes differing displacement of the carriages which, in turn, results in corresponding movement of the sub light sources 52. The differing movement of the sub light sources 52 results in them moving with respect to each other, enabling the separation between sub light sources 52 to be altered (e.g. reduced or increased).

The carriages and pulley arrangement may be situated inside the hollow support 54 of the lighting device 50. In this way, they may be hidden from view (e.g. in the support 54) and the sub light sources 52 may be perceived to slide along the outer surface of the support 54 which defines the guide path.

While specific embodiments have been described herein for purposes of illustration, various modifications will be apparent to a person skilled in the art and may be made without departing from the scope of the invention.

Figure 9:
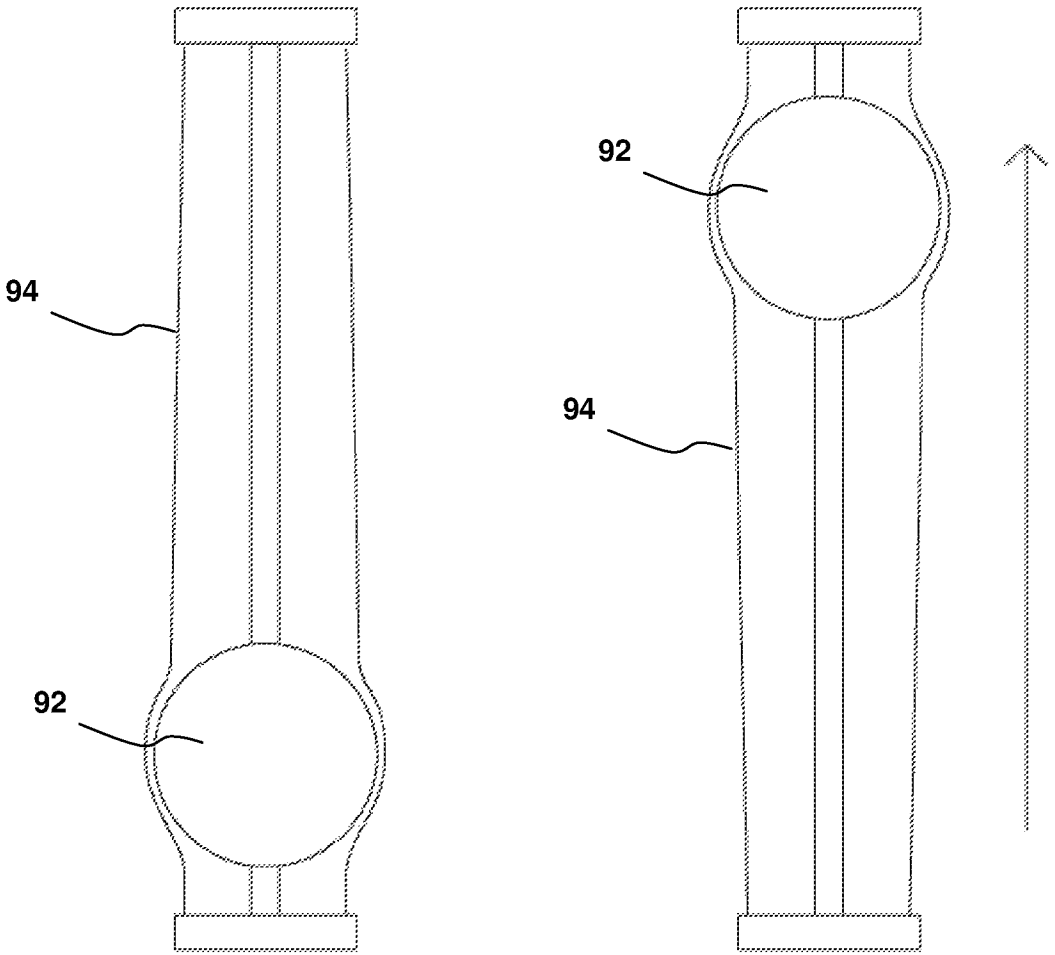
FIG. 9 depicts a lighting device according to another embodiment.
Figure 10B:
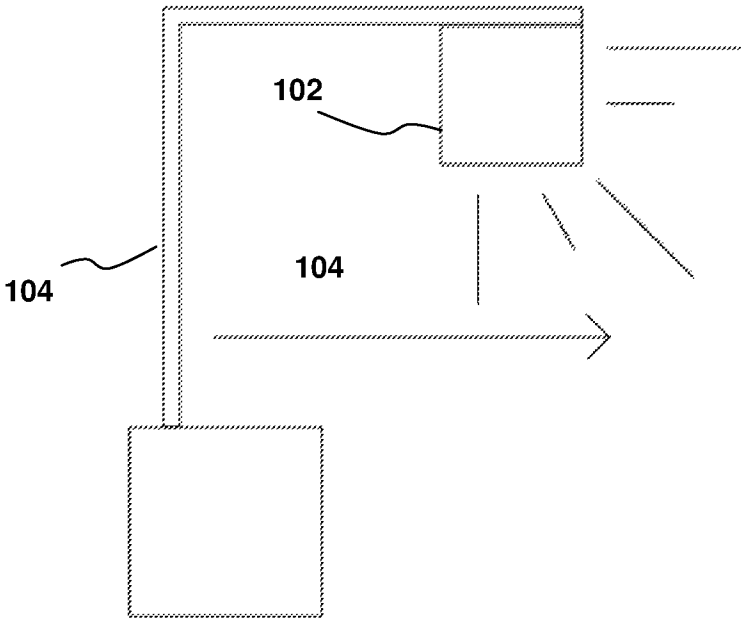
FIGS. 10A and 10B depict a lighting device according to another embodiment, wherein the light source is in a first and second position, respectively.
Figure 10A:
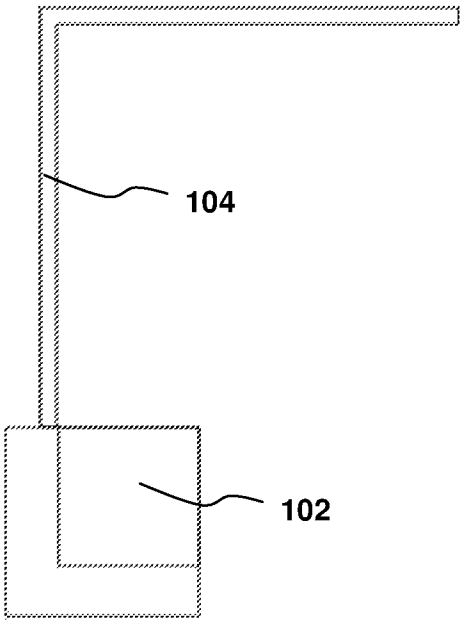
Figure 11B:
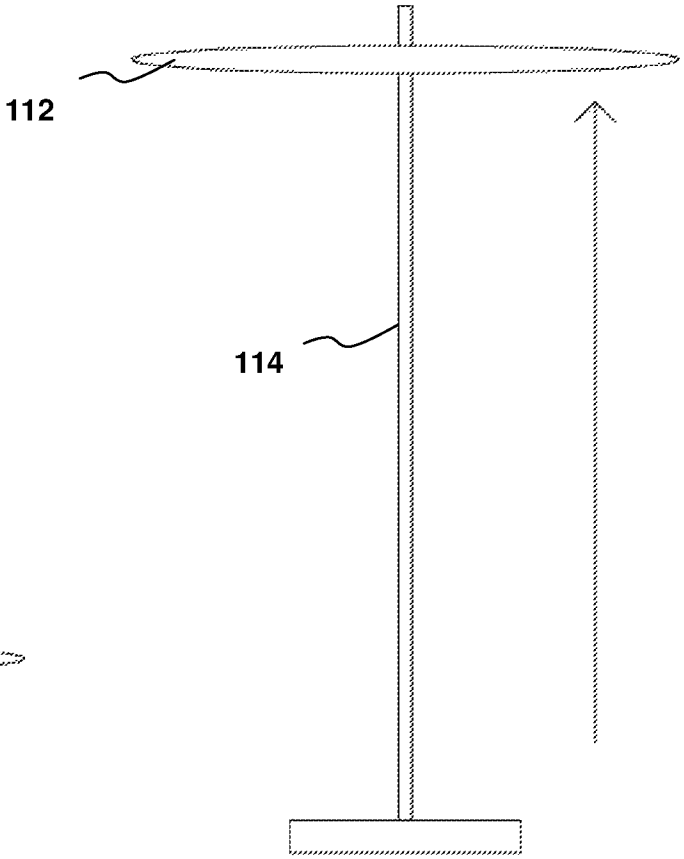
FIGS. 11A and 11B depict a lighting device according to another embodiment, wherein the light source is in a first and second position, respectively.
Figure 11A:
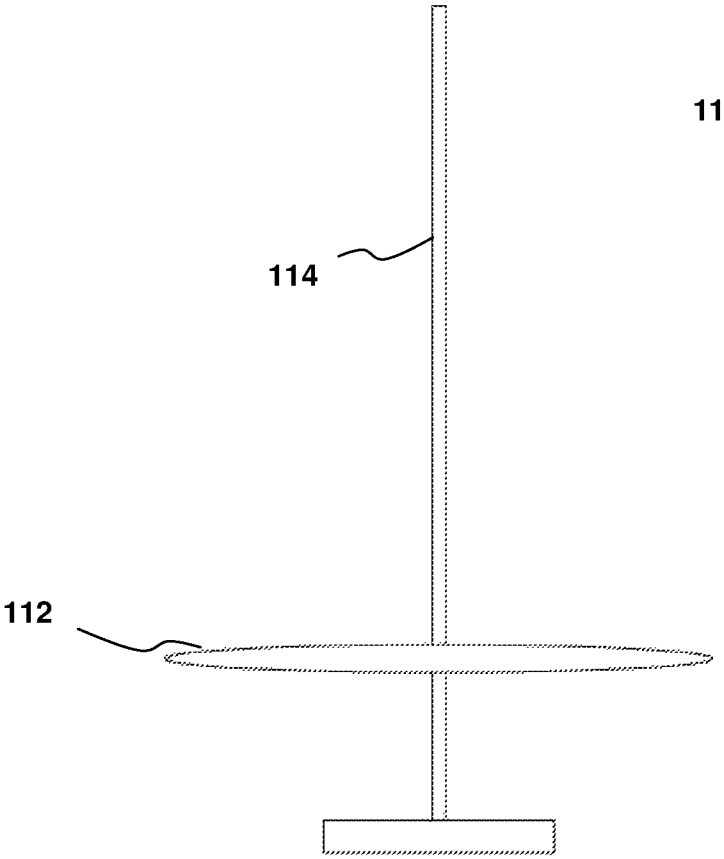

For example, FIGS. 9-11 depict various alternative embodiments by way of demonstrating modifications that may be made.

In FIG. 9, the light source 92 is held within a flexible sleeve-like support 94. The light source 92 is adapted to move along the interior of the sleeve-like support 94 between first and second lighting positions. Such movement may be driven, for example, by a pneumatic propulsion system that alters/manipulates the air pressure within the sleeve-like support 94 so as to cause movement of the light source 92.

In FIG. 10, the light source 102 is adapted to move along the surface of rigid support 104, the rigid support 104 being formed from two rigid members that are perpendicular to each other (so as to form an L-shape).

In FIG. 11, the light source 112 comprises a disc shape, wherein the center of the disc has an aperture through which an upwardly projecting support rod 114 is adapted to pass. The light source 112 is thus adapted to slide along the outer surface of the support rod 114 between first and second lighting positions.

Figure 12B:
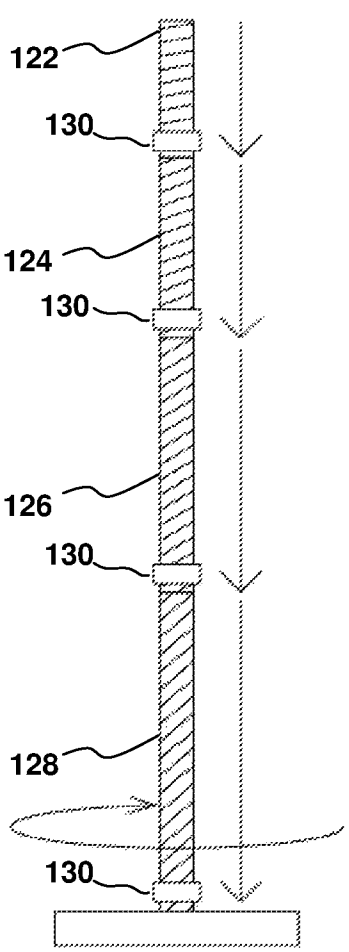
FIGS. 12A and 12B depict yet another drive arrangement for the embodiment of FIGS. 5A and 5B, wherein the drive arrangement is moved between a first and second configuration, respectively.
Figure 12A:
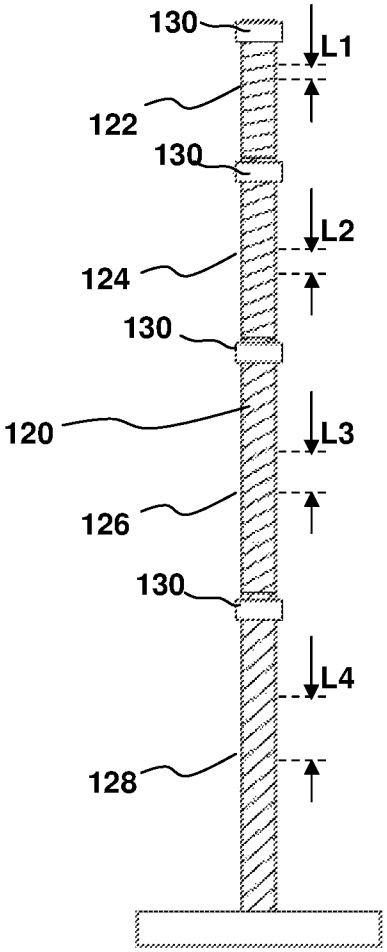

Also, FIGS. 12A and 12B depict another possible drive arrangement for the embodiment of FIGS. 5A and 5B, wherein the drive arrangement is moved between a first and second configuration, respectively.

The drive arrangement comprises a rotatable rod 120 comprising first 122 to fourth 128 threaded sections each having a different lead. The lead of a thread is the distance along the longitudinal axis (of a threaded section) that is covered by one complete rotation of the thread.

Here, the first threaded section 122 is positioned at the top of the rod 120 and has the smallest lead L1. The second threaded section 124 is positioned directly below the first threaded section 122 and has a lead L2 which is larger than the lead L1 of the first threaded section 122. The third threaded section 126 is positioned directly below the second threaded section 124 and has a lead L3 which is larger than the lead L2 of the second threaded section 124. Finally, the fourth threaded section 128 is positioned directly below the third threaded section 126 and has a lead L4 which is larger than the lead L3 of the third threaded section 126. Thus, the first 122 to fourth 128 threaded sections are arranged from top to bottom of the rod 120 such that the rod 120 is provided with threaded sections of increasing lead (from top to bottom of the rod).

Mounted (on each threaded section is a respective carriage 130. Like a nut on a threaded bolt, each carriage 130 is adapted to travel along the longitudinal axis of its respective section by rotation about the longitudinal axis (and thus being displaced by the thread). Connected to each carriage is a respective sub light source or segment 52 of the light source.

Rotation of the rod 120 (relative to the carriages 130) results in differing vertical displacement of the carriages 130 (due to the differing leads of the threaded sections) which moves the sub light sources 52 between a contracted configuration (depicted in FIG. 12A) and an expanded configuration (depicted in FIG. 12B), for example. In other words, rotation of the rod 170 causes differing displacement of the carriages 130 which, in turn, results in corresponding movement of the sub light sources 52. The differing vertical movement of the sub light sources 52 results in them moving with respect to each other, enabling the separation between sub light sources 52 to be altered (e.g. reduced or increased).

The carriages and threaded rod arrangement may be situated inside the hollow support 54 of the lighting device 50. In this way, they may be hidden from view (e.g. in the support 54) and the sub light sources 52 may be perceived to slide along the outer surface of the support 54 which defines the guide path.

The invention claimed is:

1. A lighting device for illuminating a room or enclosed area comprising:

a light source; and a support adapted to support the light source, the support having a surface which defines a guide path, wherein the light source is adapted to be movable relative to the support along the guide path between first and second lighting positions, a drive arrangement adapted to move the light source between the first and second lighting positions;

and wherein:

the light source is magnetically coupled to the drive arrangement, and wherein the light source is adapted to generate light through electromagnetic induction; and the light source comprises a plurality of sub light sources, and wherein the plurality of sub light sources are adapted to move relative to each other as the light source is moved between the first and second lighting positions.

2. The lighting device of claim 1, wherein the light source is adapted to emit light of a first intensity at the first lighting position and to emit light of a second, differing intensity at the second lighting position.

3. The lighting device of claim 2, wherein the light source is adapted to be off when at the first lighting position and to be on when at the second lighting position.

4. The lighting device of claim 2, wherein the light source is adapted to gradually change the intensity of emitted light as it is moved between the first and second lighting positions.

5. The lighting device of claim 1, wherein the light source is adapted to move between the first and second lighting positions in response to the lighting device being activated or deactivated.

6. The lighting device of claim 1, wherein the lighting device is adapted to be floor-standing.

7. The lighting device of claim 1, wherein the drive arrangement comprises a gearing arrangement at least partially housed within the support.

8. The lighting device of claim 1, wherein the drive arrangement comprises at least one of:

a motor and pulley system at least partially housed within the support; a magnetic propulsion system at least partially housed within the support;

a flexible screw arrangement at least partially housed within the support;

a pneumatic propulsion system at least partially housed within the support;

a rack and pinion mechanism at least partially housed within the support;

a tension spring at least partially housed within the support;

a threaded rod having sections with differing thread lead; and a gearing arrangement at least partially housed within the support.

* * * * *